US008739716B2

(12) United States Patent
Price et al.

(10) Patent No.: US 8,739,716 B2
(45) Date of Patent: Jun. 3, 2014

(54) AUTOMATED QUILTING AND TUFTING SYSTEM

(75) Inventors: Elvin C. Price, Dacula, GA (US); Preston B. Dasher, Lawrenceville, GA (US); Jeffrey S. Kane, Lawrenceville, GA (US); George A. Price, Lawrenceville, GA (US); Danny V. Murphy, Dacula, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 713 days.

(21) Appl. No.: 13/032,693

(22) Filed: Feb. 23, 2011

(65) Prior Publication Data

US 2011/0203506 A1 Aug. 25, 2011

Related U.S. Application Data

(60) Provisional application No. 61/306,989, filed on Feb. 23, 2010.

(51) Int. Cl.
*D05C 15/16* (2006.01)

(52) U.S. Cl.
USPC ..... 112/475.23; 112/475.07; 112/80.01

(58) Field of Classification Search
USPC ..... 112/410, 2.1, 2.2, 80.01, 80.17, 80.5, 112/475.23, 475.04, 475.07
See application file for complete search history.

(56) References Cited

U.S. PATENT DOCUMENTS

| | | | |
|---|---|---|---|
| 1,983,169 | A | 12/1934 | Gail |
| 2,087,847 | A | 7/1937 | Morley |
| 2,089,252 | A | 8/1937 | Droll |
| 2,192,161 | A | 2/1940 | Fridolph |
| 2,610,436 | A | 9/1952 | Honeycutt |
| 2,649,065 | A | 8/1953 | Casper |
| 2,756,443 | A | 7/1956 | Gitlin |
| 2,787,230 | A | 4/1957 | Fasey |
| 2,920,588 | A | 1/1960 | Bronstein |
| 3,016,852 | A | 1/1962 | Johnson |
| 3,062,161 | A | 11/1962 | Amos |
| 3,146,517 | A | 9/1964 | Skeen |
| 3,883,163 | A | 5/1975 | Nestenius |
| 3,896,747 | A | 7/1975 | Amos |
| 4,501,208 | A | 2/1985 | Landoni |
| 5,005,499 | A | 4/1991 | Landoni |
| 5,154,130 | A | 10/1992 | Gribetz et al. |
| 5,373,795 | A | 12/1994 | Kato |
| 5,509,365 | A | 4/1996 | Cash |
| 5,603,270 | A | 2/1997 | White et al. |

(Continued)

FOREIGN PATENT DOCUMENTS

| | | | |
|---|---|---|---|
| EP | 0394601 | A1 | 10/1990 |
| EP | 0844210 | A2 | 5/1998 |

(Continued)

*Primary Examiner* — Danny Worrell
(74) *Attorney, Agent, or Firm* — Womble Carlyle Sandridge & Rice LLP

(57) ABSTRACT

An automated quilting and tufting system for application of tufts at selected locations along a web of material, including a sewing head receiving a series of tufts or rosettes from a supply. The tufts are removed from their supply and are placed at selected locations on the web of material for attachment to the web of material by the sewing head. Thereafter, the web of material can be cut to form a panel of a desired size.

19 Claims, 9 Drawing Sheets

(56) References Cited

U.S. PATENT DOCUMENTS

| | | | | |
|---|---|---|---|---|
| 5,647,293 | A | 7/1997 | Price et al. | |
| 5,832,849 | A | 11/1998 | Kaetterhenry et al. | |
| 5,839,382 | A | 11/1998 | Tice et al. | |
| 6,012,403 | A | 1/2000 | Codos et al. | |
| 6,026,756 | A * | 2/2000 | Frazer et al. | 112/118 |
| 6,032,345 | A | 3/2000 | Resta | |
| 6,145,456 | A | 11/2000 | Codos | |
| 6,170,414 | B1 | 1/2001 | Kaetterhenry et al. | |
| 6,237,517 | B1 * | 5/2001 | Bondanza et al. | 112/118 |
| 6,263,816 | B1 | 7/2001 | Codos et al. | |
| 6,523,921 | B2 | 2/2003 | Codos | |
| 6,662,737 | B2 | 12/2003 | Marcangelo et al. | |
| 6,804,940 | B2 | 10/2004 | Resta | |
| 6,848,846 | B2 | 2/2005 | Codos et al. | |
| 6,895,878 | B2 | 5/2005 | Stutznacker | |
| 7,073,453 | B2 * | 7/2006 | Frazer et al. | 112/117 |
| 7,100,526 | B1 | 9/2006 | Olewicz et al. | |
| 7,143,705 | B2 * | 12/2006 | Frazer et al. | 112/117 |
| 7,191,716 | B2 | 3/2007 | Dixon et al. | |
| 7,383,676 | B1 | 6/2008 | Schmidt et al. | |
| 7,445,829 | B2 | 11/2008 | Whaley | |
| 7,735,439 | B1 | 6/2010 | Price et al. | |
| 7,770,530 | B2 | 8/2010 | James et al. | |
| 7,789,028 | B2 * | 9/2010 | James et al. | 112/117 |
| 8,061,288 | B2 * | 11/2011 | James et al. | 112/475.08 |
| 2002/0104468 | A1 | 8/2002 | Myers et al. | |
| 2002/0166467 | A1 | 11/2002 | Codos et al. | |
| 2004/0040134 | A1 | 3/2004 | Resta | |

FOREIGN PATENT DOCUMENTS

| | | | |
|---|---|---|---|
| EP | 1253107 | A1 | 10/2002 |
| EP | 1275615 | A2 | 1/2003 |
| EP | 1348790 | A1 | 10/2003 |
| EP | 1394099 | A1 | 3/2004 |
| EP | 1681960 | B1 | 5/2009 |
| GB | 2282756 | A | 4/1995 |
| GB | 2349332 | A | 11/2000 |
| GB | 2381744 | A | 5/2003 |
| WO | WO2005005307 | A1 | 1/2005 |
| WO | WO2005027689 | A2 | 3/2005 |
| WO | WO2005027689 | A3 | 8/2006 |

* cited by examiner

AUTOMATED QUILTING AND TUFTING SYSTEM

CROSS-REFERENCE TO RELATED APPLICATION

The present patent application is a formalization of previously filed U.S. Provisional Patent Application Ser. No. 61/306,989, filed Feb. 23, 2010, by the inventors named in the present application. This patent application claims the benefit of the filing date of the cited provisional patent application according to the statutes and rules governing provisional patent applications, particularly 35 U.S.C. §119(e)(1) and 37 CFR §1.78(a)(4) and (a)(5). The specification and drawings of the provisional patent application are specifically incorporated herein by reference.

FIELD OF THE INVENTION

The present invention generally is directed to systems for sewing and/or tufting fabric materials, and in particular to a system for sewing decorative patterns and/or installing tufted decorations in fabric panels such as for use in the formation of mattresses and other bedding materials.

BACKGROUND OF THE INVENTION

In recent years, mattresses and other bedding materials have been evolving from simple cushioned spring frames to more complex sleep systems in order to meet changing consumer needs and demands. For example, various type or style pillow top mattresses and mattresses using visco-elastic materials, such as "memory-foam" or other similar materials, are becoming increasingly popular with consumers as consumers have begun to demand more variations in comfort to fit their differing needs and preferences. In addition, demand has increased for more decorative or aesthetically pleasing appearances for mattresses, box springs and other bedding materials, especially for higher-end, more expensive bedding materials. Mattress manufacturers have begun to recognize that purchasers of such expensive, higher-end mattresses and other, similar bedding materials also are looking for more aesthetically pleasing or decorative looks for such mattresses, especially when they are paying higher prices for such mattresses and bedding materials.

An increasingly popular style of mattress being sold today is the so-called "tufted" mattress in which a mattress, with or without decorative stitching or scrollwork patterning, will have a series of tufts or "rosettes" affixed or inserted at spaced locations across the top of the mattress. These rosettes can be formed from loops of yarns, from buttons, or other decorative materials and generally are punched into the mattresses. Such tufted mattresses generally have been viewed as being in a category of higher-end, more expensive types of mattresses, due to the much more labor intensive and thus more expensive process of manufacture for such tufted mattresses.

In the past, such tufted decorations typically have been applied to mattresses by hand, by an operator physically punching or inserting the rosette, or a thread or yarn attached to the rosette, through the mattress after the mattress has been assembled, using a hand tool and one or more series of clamps to hold and compress the mattress. More recently, machinery has been developed to help clamp and compress substantially the entire mattress, with the mattress in a substantially uniformly compressed state for application of the tufts or rosettes thereto. However, even with the use of such machinery or systems for clamping and compressing the mattresses for application of tufts, the actual insertion of the tufts still generally is required to be a manual operation with an operator physically inserting each tuft or rosette into/through the mattress by hand. As a result, while some of the labor and associated costs therewith have been reduced by such equipment, the production of tufted mattresses and other, similar tufted bedding articles still remains a largely manual or labor intensive operation, which limits production and keeps the cost of such tufted bedding at a generally higher level.

Accordingly, it can be seen that a need exists for automated systems and methods for application of tufted decorations to mattresses and other, similar bedding materials that addresses the foregoing and other related and unrelated problems in the art.

SUMMARY OF THE INVENTION

Briefly described, the present invention generally comprises an automated quilting and tufting system adapted to automatically apply tufts, rosettes or other decorative attachments to and/or for sewing decorative patterns in a fabric material web such as for forming fabric panels for use in mattresses, borders and other bedding materials. The automated quilting and tufting system generally will include a first or upstream infeed section from which a series of material rolls such as fabric ticking materials, foam or cushioning material and other similar, fabric or textile panel materials will be fed in stacked sheets or layers into a sewing area for attachment at the tufts or rosettes thereto and/or for sewing of a quilted or other decorative pattern in the fabric materials. Once a sufficient length of material has been fed into the intermediate section, the web of material typically will be clamped or otherwise engaged and held along its side edges by a pair of longitudinal clamps. After sewing of the web of material, the web of material will be fed into a downstream outlet section, for cutting a desired length panel. The automated quilting and tufting system of the present invention further generally will include a programmable computer control system for controlling feeding, quilting, tufting and panel cutting operations.

A series of tufts will be fed individually from one or more hoppers by tuft conveyors operating with an indexed, incremental motion so as to sequentially move the tufts out of the hoppers and into an initial or first, pick position or to alert the operator that one or more hoppers is out of tufts. The flights of the tuft conveyors will be monitored by a first tuft sensor so as to continue operation of the tuft conveyors until a tuft is detected as reaching its pick position. Thereafter, the sensor will signal the control system to engage a stop mechanism to stop further movement of the tuft conveyor while the selected tuft is removed therefrom by a first transfer mechanism which moves the tuft from the flight of its tufting conveyor to a secondary or transfer position. The first transfer mechanism generally includes a gripper mounted to a moveable carriage and having a pair of extensible fingers. The carriage is moved laterally in a reciprocating motion so as to move the gripper into a position above the pick point of each tuft conveyor, whereupon the gripper will engage and collect the tuft, after which the carriage will be retracted to a centrally located position, whereupon the gripper will deposit the tuft on a seat or receptacle at the transfer position. A secondary tuft transfer mechanism thereafter engages and moves the tuft into the sewing position for attachment to the web of material. The secondary tuft transfer mechanism includes a second gripper having fingers for engaging and gripping the tuft, and further generally will be pivotally attached to a pivotable guide arm. After engagement of the tuft at the transfer position, the guide arm will be pivoted and lowered toward the sewing area, while its gripper likewise generally will be pivoted or rotated to reposition the tuft for placement at the sewing area.

Once the tuft has been placed at the sewing area on top of the web of material, the guide arm of the secondary tuft transfer mechanism is retracted as a presser foot engages the web of material and the sewing needle of a sewing head engages and sews the tuft to the tufted web of material. In addition, the sewing head can be operated independently of the application of the tufts for sewing a quilted or other decorative pattern in the web of material. The sewing head and presser foot further are attached to a laterally moveable carriage mounted on a longitudinally moveable drive platform. During a sewing operation, the carriage can move the sewing head laterally as the drive platform is moved longitudinally with respect to the web of material so as to enable sewing of a variety of different patterns and the repositioning of the sewing head as needed to apply the tufts at desired locations across the web of material.

Upon completion of a sewing operation and/or application of a desired number of tufts, the longitudinal clamps will be released from engagement with the web of material, which thereafter will be incremented forwardly into and through the downstream outlet section of the automated quilting and tufting system. The outlet section generally will include a panel cutter having a pair of side cutting assemblies that are moveable laterally across the width of the panel cutter for trimming or cutting the side edges of the web of material, and a longitudinal cutter for cutting laterally across the web of material for cutting a panel of a desired length, such as for forming a king size, queen size, double, etc., mattress. The cut panels thereafter can be collected for transport to further sewing stations for attachment to a mattress, etc.

BRIEF DESCRIPTION OF THE FIGURES

The drawings attached herewith as FIGS. 1A-6B illustrate one example embodiment of the automated quilting and tufting system according to the principles of the present invention. However, it will be understood by those skilled in the art that various modifications, additions and/or changes also can be made thereto without departing from the spirit and scope of the invention. In addition, various features, objects and advantages of the present invention will become apparent to those skilled in the art upon a review of the figures, when taken in conjunction with the accompanying description.

DETAILED DESCRIPTION OF THE INVENTION

Figure 1A:
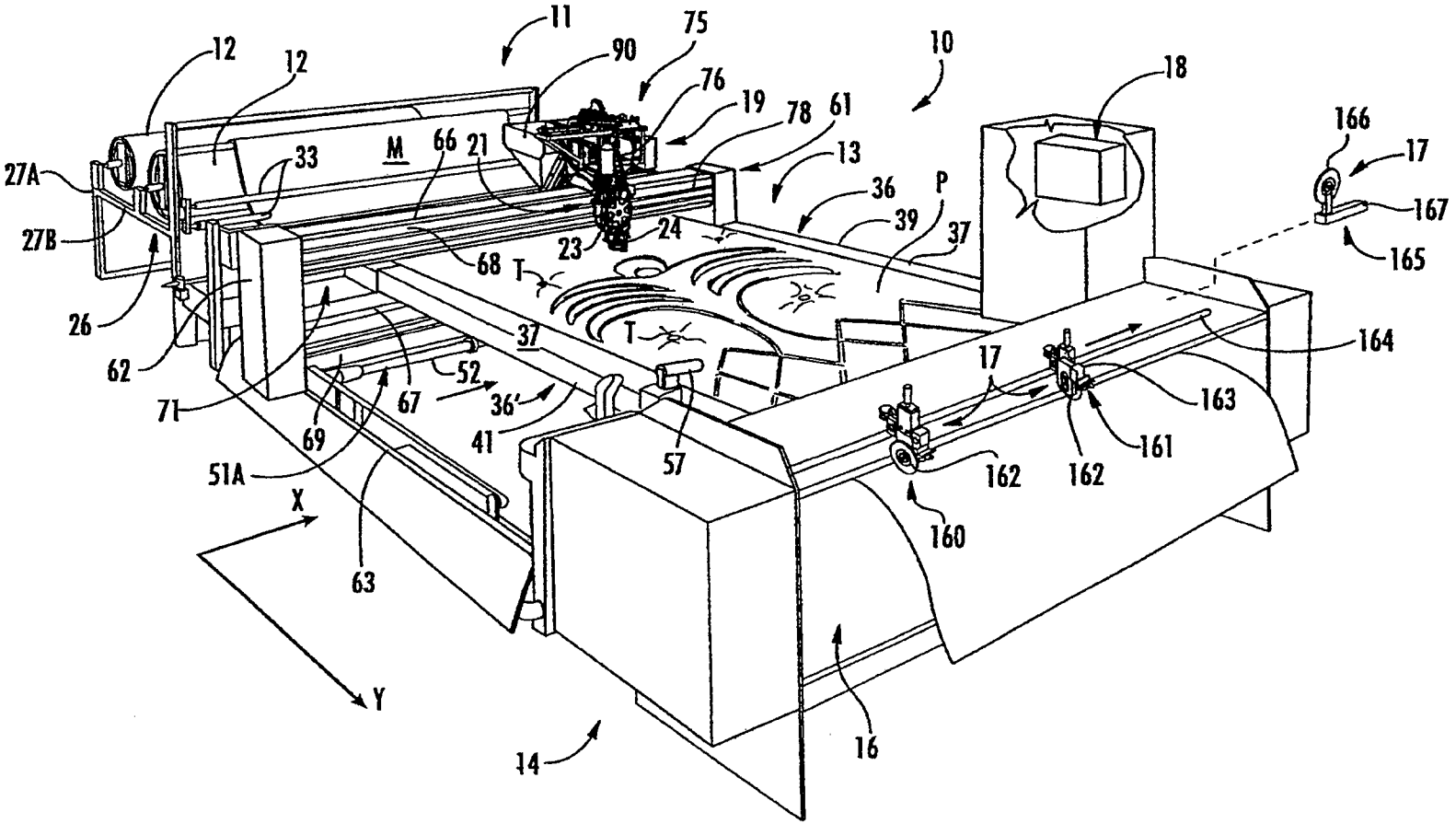
FIG. 1A is a perspective view of one example embodiment of the quilting and tufting system according to the principles of the present invention.

Referring now to the Figures, FIGS. 1A-6B generally illustrate one example embodiment of an automated quilting and tufting system 10 according to the principles of the present invention. As indicated in FIGS. 1A and 1B, the automated quilting and tufting system 10 generally includes a first, upstream or infeed section 11, at which a series of material rolls such as rolls 12 for fabric ticking materials, foam materials and other, similar fabric or textile panel materials M will be placed for feeding sheets or layers of such fabric materials into a second, downstream intermediate or quilting/tufting section 13 in which the layered fabric materials are clamped together and are sewn with a desired quilted pattern and/or at which a series of tufts T or rosettes, or other, similar decorations, are applied to the fabric materials, as indicated in FIG. 1C. Downstream from the intermediate section 13 is a third, output section 14 (FIG. 1A), which typically can include a panel cutter 16 having one or more cutting assemblies 17 for cutting the quilted and/or tufted materials into panels, borders or other fabric articles of desired lengths and/or widths.

A programmable computer control system 18 for the automated quilting and tufting system 10 further will be provided for controlling feeding, quilting, tufting and panel cutting operations, and can include a user interface, such as a touchscreen, keyboard monitor, etc., or can be linked to a central server or control system for receiving and/or input of pattern or control instructions. In addition, an encoder mounted adjacent the outlet section or panel cutter provides feedback to the control system to enable the control system 18 to determine when a desired length of the quilted and/or tufted materials has been fed therethrough, indicative of a desired size panel (i.e., king, queen, etc.), likewise having been fed into the intermediate quilter/tufter section), after which the sewn panel area can be cut by the panel cutter 16, while the next length of panel material can be clamped and sewn by the quilter/tufter section 13. As a result, a series of panels P, such as for use in forming mattresses, borders or other bedding or similar materials can be formed automatically by the feeding of a series of fabric and/or cushioning materials in a stacked or sandwiched/layered configuration through the intermediate and output sections in lengths sufficient to form a panel of a desired size, i.e., a king size, queen size, double or other size panel.

The layered fabric materials will be fed into the intermediate section and clamped along the side portions thereof for quilting/tufting. Thereafter, as indicated in FIG. 1C, the sandwiched layers of fabric materials will be engaged by a quilter/tufter assembly 19. The quilter/tufter assembly 19 (FIGS. 2, 3 and 5-6B) includes spaced upper and lower carriages 21 and 22 carrying a sewing head 23 and presser foot assembly 24, respectively. The quilter/tufter assembly can sew a desired quilted or other decorative pattern into the panel, which accordingly further sews the panel layers together and can apply a series of tufts T or rosettes to the panel P at desired, spaced locations thereabout, as shown in FIG. 1C. Alternatively, the quilter/tufter assembly can simply sew the edges of the fabric materials together to form a panel. Once the desired panel has been fully sewn and all tufts or other similar decorations have been applied thereto, the control system can halt further sewing and quilting operations, trim any remaining thread and thereafter engage the downstream panel cutter 16

(FIG. 1A) to pull the sewn/tufted panel material therethrough for cutting to a desired panel size.

Figure 1B:
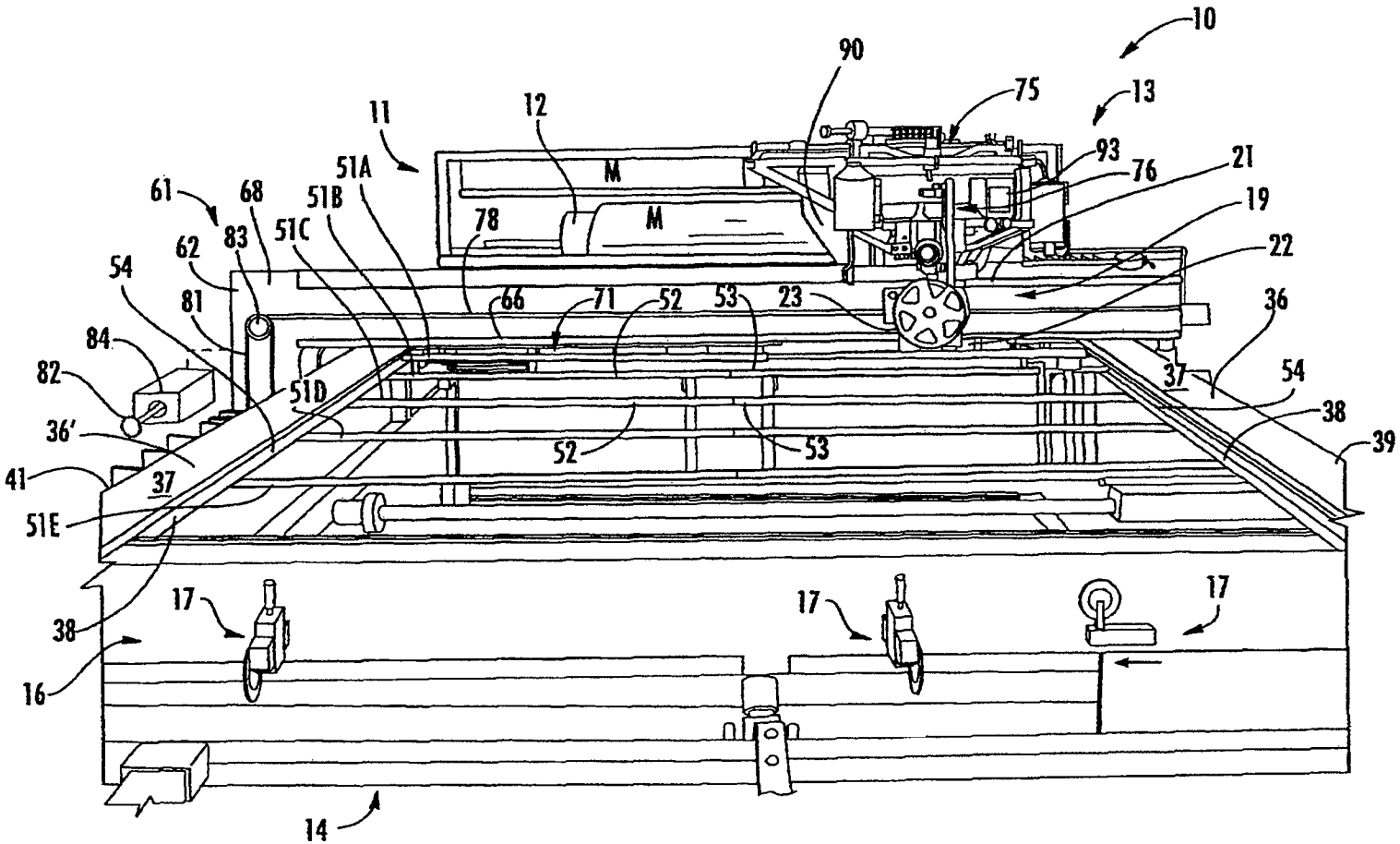
FIG. 1B is an end view illustrating the quilting and tufting system according to an example embodiment of the present invention.
Figure 1C:
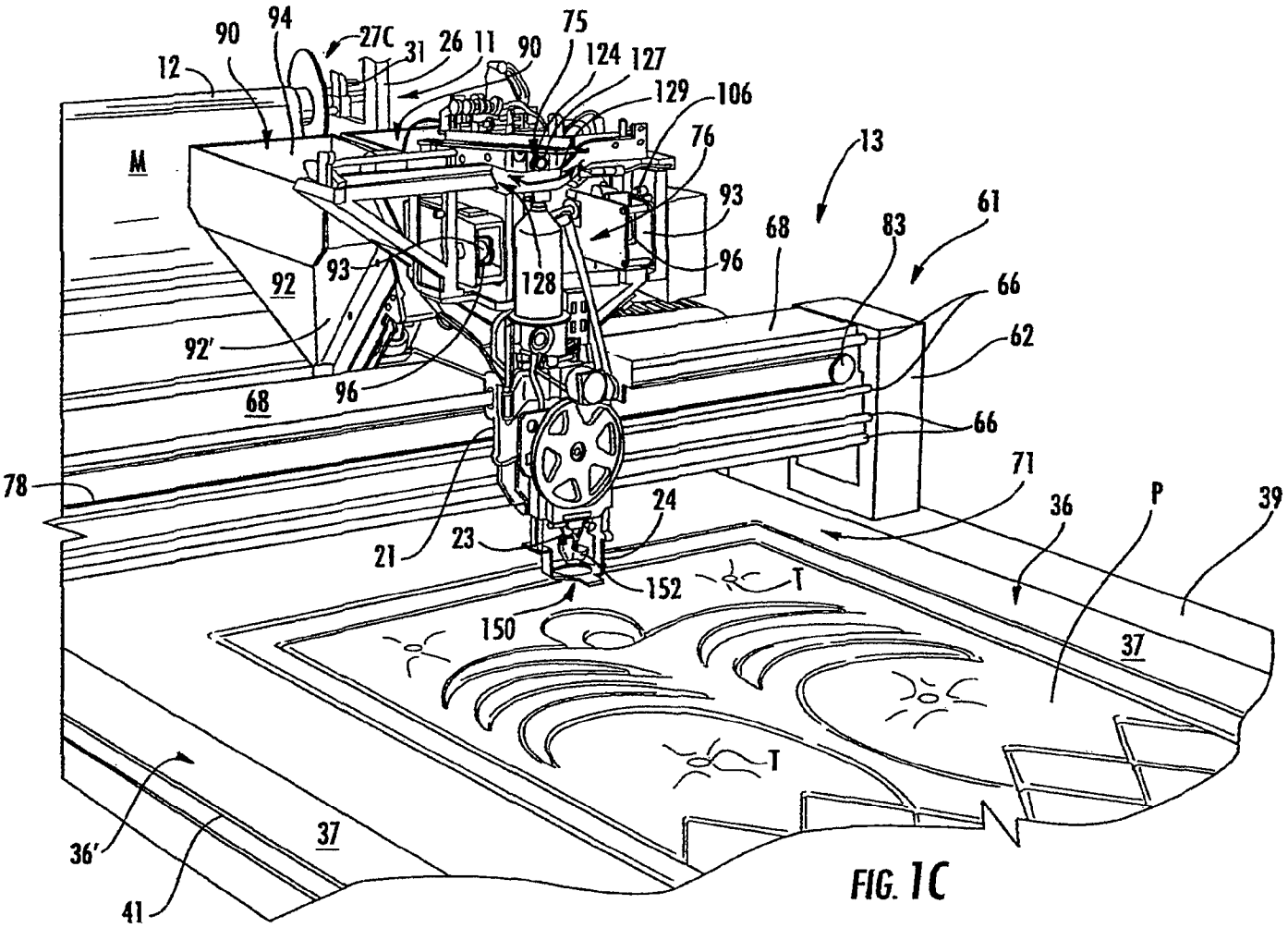
FIG. 1C is a perspective view of the sewing head and tuft applicator applying tufts or rosettes to a web of panel material.
Figure 2:
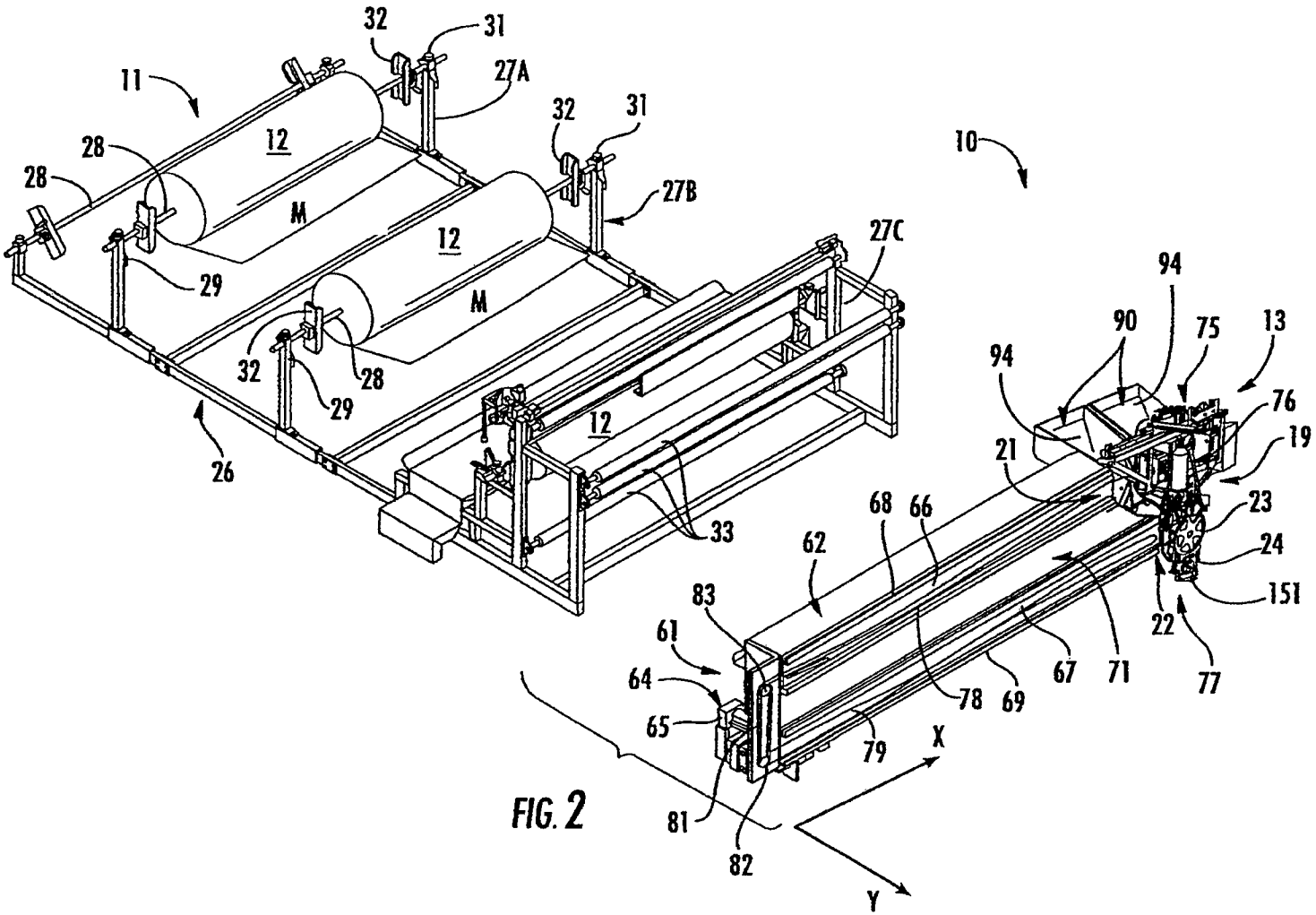
FIG. 2 is perspective view of the material racks of the infeed section of the quilting and tufting system of FIGS. 1A-1C.

As indicated in FIGS. 1A, 1B, and 2, the upstream or infeed section 11 of the automated quilting and tufting system 10 generally will include a framework 26 having a series of material roll holders 27A-27C on which rolls of various panel materials M (FIG. 1A) can be rotatably mounted. Here, 2-3 roll holders are shown although it will be understood by those skilled in the art that more or fewer roll holders can be provided. Additionally, it should be understood that carousel type roll holding systems also can be used. Such rolls of panel/fabric materials can include one or more foam or cushioning material layers, fabric ticking materials, flanging materials and/or other, similar materials. The rolls of panel materials generally will be rotatably mounted on an axle or shaft 28 of each roll holder, the axles secured to frame supports 29 at the opposite ends thereof by locking clamps 31 to enable removal and/or substitution of the material rolls as needed. Sliding clamps 32 additionally can be used for positioning the rolls laterally along their axles or rotating shafts. The material layers will be fed around a series of idler rollers 33, which help guide the various layers of fabric materials into registration, causing the layers to be stacked together for feeding into the downstream intermediate and outlet sections 13/14 of the automated quilting and tufting system 10.

Figure 3:
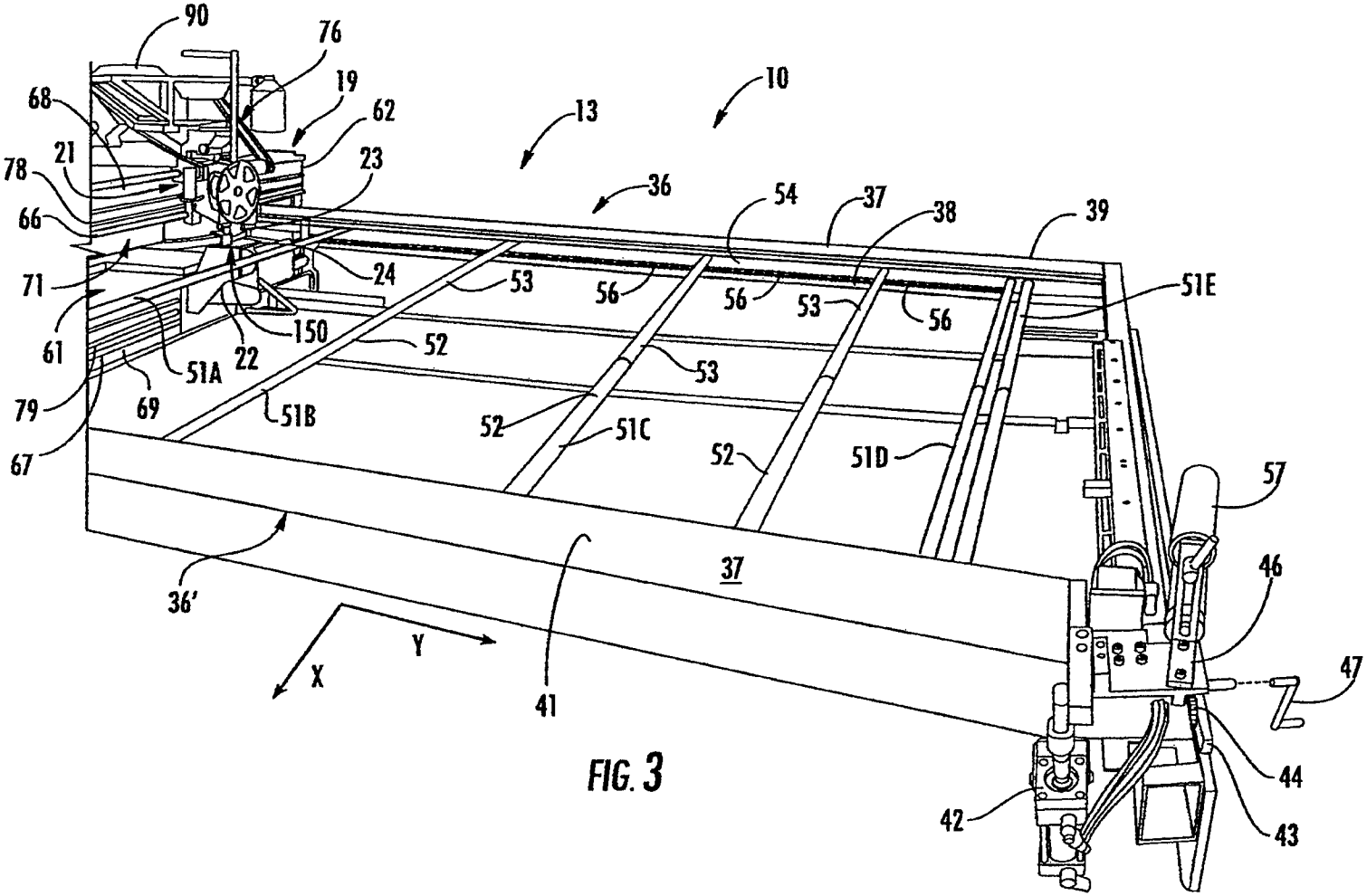
FIG. 3 is a perspective illustration of the quilting/tufting assembly and supports for supporting a web of panel material during a sewing operation.

As indicated in FIGS. 1A-1C and 2, the stacked or sandwiched panel materials M are fed in a substantially continuous web through the upstream or proximal end of the intermediate section 13, passing between the upper and lower carriages 21, 22 of the quilter/tufter assembly 19. After a sufficient length of this web has been fed into and through the intermediate section to form a desired size panel P (FIGS. 1A and 1C), the web of panel materials is engaged along the outer side edges thereof by longitudinally extending clamp plates 36/36', as indicated in FIGS. 1A-1C. As FIG. 3 illustrates, the clamp plates 36/36' include pairs of upper and lower, parallel plates 37 and 38 extending along the longitudinal side edges 39 and 41 of the intermediate section 13. The clamp plates 36/36' are moved into compressive, clamping engagement with the side edges of the web of panel materials by engagement and operation of one or more actuators 42 such as pneumatic or hydraulic cylinders, although motors, such as servo or stepper motors, or other, similar types of actuators also can be used. The actuators will be controlled by the control system of the automated quilting and tufting system so as to engage the clamp plates upon detection of a desired length or amount of the panel material being fed into the intermediate section by the downstream encoder.

As further illustrated in FIG. 3, at least one of the longitudinally extending side clamp plates 36' can be mounted on a slide or rack 43 for adjusting the lateral position of the clamp plates (in the "X" direction) as needed to accommodate different size panel webs or to correct the positioning of the clamp plates as needed to accommodate for minor inconsistencies in the width of the panel webs. Such motion can be accomplished by engagement of a gear 44 linked to a slide or carriage 46 for the clamp plate 36' that engages the rack 43 and is operable by means of a manually operated crank 47 or through the use of a drive motor or similar actuator under control of the control system for the automated quilting and tufting system 10. The length or amount of adjustment further can be limited as needed or desired to meet a desired calibrated adjustment.

As additionally illustrated in FIG. 3, the intermediate section 13 further generally will include a series of support rails 51A-51E moveable along and extending between the longitudinal clamp plates. Such support rails can include two or more telescoping rods 52/53, which enable the support rails to be extended and retracted as needed with the lateral movement of the longitudinal clamp plates 36/36'. The foremost or upstream support rail 51A typically further will be connected to a drive platform 61 for the quilter/tufter assembly 19 so as to be located at a desired spacing therefrom and moveable therewith, while the downstream or additional support rails 51B-51E typically will be freely slideable along tracks or guides 54 mounted below the longitudinal clamp plates 36. The support rails further typically will be linked to one another and to the initial or upstream support rail by chains, cables or similar attachment mechanisms 56 so that a maximum spacing between the support rails will be maintained and not exceeded regardless of the size panel being sewn. The slideable engagement of the ends of the support rails within their guide tracks further enables the telescoping rods 52/53 to be moved together or apart as needed to support panels of varying sizes, without necessarily requiring operator adjustment of their positions. As FIGS. 1A and 3 further illustrate, one or more sets of idler or guide rolls 57 additionally typically will be mounted at or adjacent the downstream ends of the intermediate section to help guide the side edges of the sewn panel P into the downstream outlet section 14 and/or panel cutter 16.

As further indicated in FIGS. 1A, 1B, 1C, 2 and 6A-6B, the drive platform 61 for the quilter/tufter assembly 19 of the intermediate section 13 of the automated quilting and tufting system 10 generally will include a laterally extending frame 62 adapted to be moveable longitudinally along a pair of side guide tracks or rails 63 (only one of which is shown in FIG. 1A) under control of one or more actuators 64 (FIG. 2), such as drive motors 65, controlled by the computer control system 18 (FIG. 1A) of the automated quilting and tufting system. The drive platform 61 thus is moveable longitudinally between an initial, proximal or start position adjacent the input section 11 and a distal or end position adjacent the output section 14 or panel cutter 16 for moving the quilter/tufter assembly in a longitudinal or "Y" direction substantially along the length of the web of panel material.

As noted, the quilter/tufter assembly 19 (FIG. 2) further comprises spaced upper and lower carriages 21 and 22, which ride along pairs of laterally extending guide rails 66/67 mounted to the spaced upper and lower sections 68/69 of the drive platform. As indicated, the upper and lower sections of the drive platform are spaced apart so as to define an opening or passage 71 through which the web of panel material will be fed and passed for clamping engagement of the side edges thereof by the longitudinal clamps 36, 36' (FIG. 1A) of the intermediate section. As also indicated in FIGS. 1B and 2, the quilter/tufter assembly further will include and carry first and second tuft feeding and transfer mechanisms 75 and 76, the sewing head 23, and the presser foot assembly 24 supported on and movable laterally by the upper carriage 21, with a looper or base assembly 77 located therebelow on the lower carriage and moveable in a cooperative motion to the movement of the sewing head and presser foot assembly by the upper carriage. The upper and lower sections will move in a matching, mirror arrangement for sewing desired, quilted patterns and/or for the application of tufts T (FIG. 1C) at various locations or points across the length and width of the panel web.

As also indicated in FIG. 2, the lateral motion of the upper and lower carriages 21/22 is controlled by laterally extending drive belts 78/79 that further are linked together by a synching drive belt 81, which extends about and drives upper and lower drive gears or pulleys 82/83 for the upper and lower drive belts 78/79. One or more drive motors 84 controlled by the control system of the automated panel tufting system 10 are mounted to the drive platform 61 for driving the drive belts so as to cause the upper and lower carriages to be moved in mirror fashion laterally in the "X" direction across the width of the panel web for applying quilting/stitching and/or for insertion of the tufts or rosettes therein.

Figure 4:
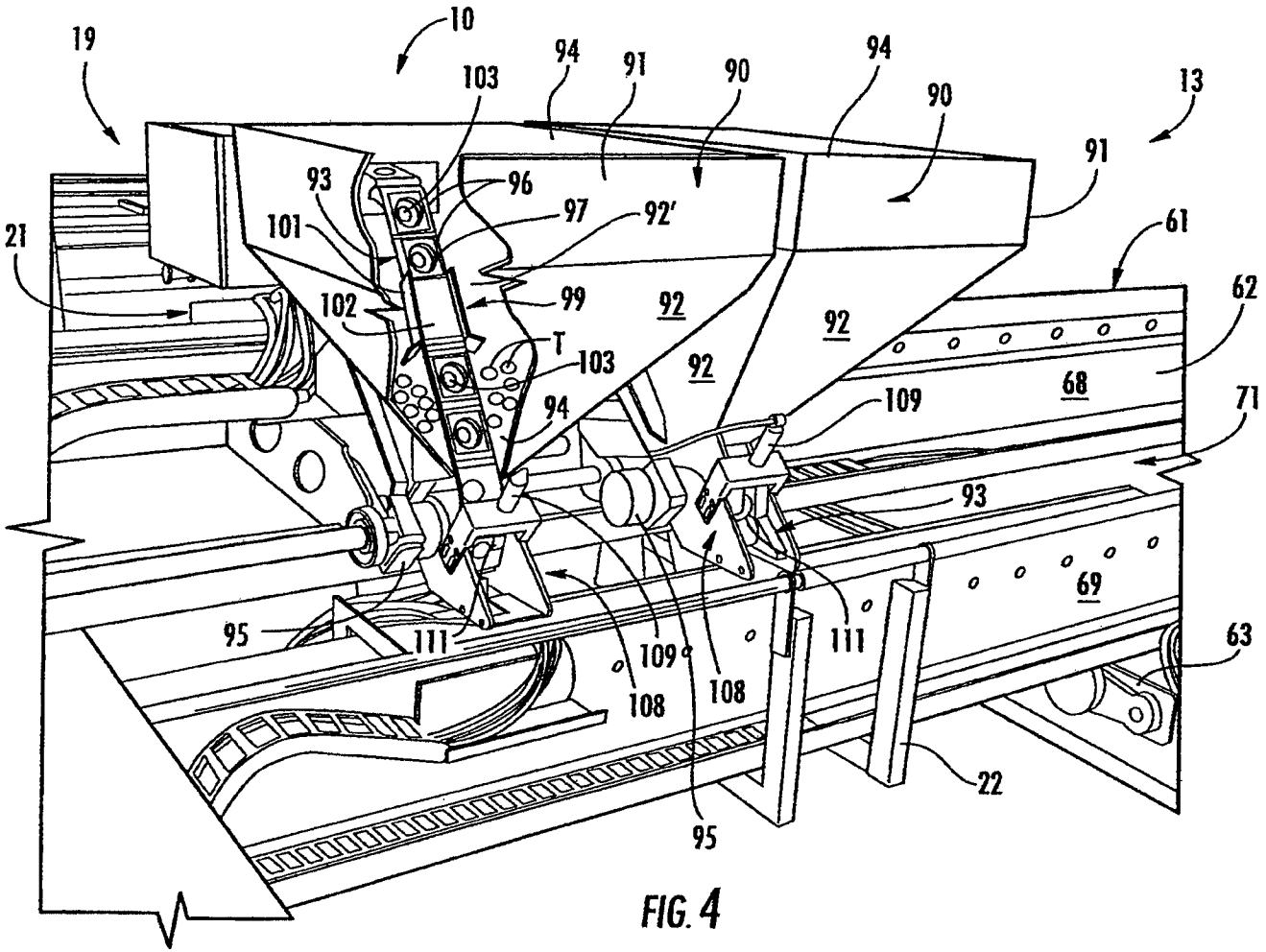
FIG. 4 is a perspective view of the supply hoppers for supplying the tufts or rosettes to be sewn to a fabric panel.

As illustrated in FIGS. 1B, 1C, 2 and 4, hoppers 90 for the storage and supply of tufts T or rosettes to the sewing head of the quilter/tufter assembly 19 generally will be mounted along a rear or upstream side of the upper carriage 21 of the quilter/tufter assembly so as to be moveable therewith. As indicated in FIG. 4, a pair of side-by-side hoppers 90 typically can be provided, although fewer or more hoppers also can be provided as needed, with tufts or rosettes being fed from only 1 or from both hoppers as needed or desired. The use of multiple hoppers thus enables the supply of different types of rosettes or tufts, e.g., different color tufts, different material tufts, tufts of different sizes, etc., to be fed to the sewing head as needed for forming a variety of decorative looks or features in the panels.

Each of the hoppers 90 generally will include a tapered or funnel-shaped body 91 having downwardly sloping sidewalls 92 that terminate at a bottom opening through which a tuft conveyor 93 extends. The hoppers thus define bins or receiving areas 94 in which a series of tufts T or rosettes can be deposited and stored (as shown in FIG. 4) for removal and application to the panel web as needed. The tuft conveyors 93 generally are indexing conveyors including a series of separated flights 96 or sections each having a recess or receiving area 97 in which a tuft or rosette will be received and conveyed out of the hopper 90.

The tuft conveyors 93 are indexed forwardly by indexing motors 95 that index or cycle the conveyors by one increment substantially equivalent to the length of one section or flight 96. As indicated in FIG. 3, the indexing tuft conveyors will extend upwardly at an angle along the front face or side wall 92' of their hopper toward a tuft discharge position 98 (FIG. 5) adjacent the sewing head 23 for removal of the tufts or rosettes therefrom, and further generally will pass through a gate or tuft guide 99 (FIG. 4) adjacent the upper end of the hopper. This tuft guide 99 can include a series of angled guide plates 101/102 that will engage and help ensure proper seating of the tufts T or rosettes within the recesses 97 of the conveyor flights 96, or alternatively, if a tuft or rosette is not properly seated, the guide plates can help urge the tuft or rosette out of the conveyor to guard against misalignment or twisting of the tuft or rosette and disruption or possible jamming of the indexing tuft conveyor or downstream tuft transfer mechanism 75.

Each of the recesses 97 of the flights 96 of each tuft conveyor 93 further can have a reflective material 103 applied thereto such that should a tuft T not be properly seated or fall out of the conveyor flight as it is indexed or incremented forwardly, such an open flight or missing tuft can be detected by a first or tuft sensor 106 (FIG. 5) mounted adjacent the discharge position 98 of each indexing tuft conveyor. The control system can be programmed so that if one or more open flights or conveyor increments are detected, the indexing conveyor can simply be cycled further forwardly, such as at a different rate, as needed to bring a tuft or rosette into the discharge position 98 for engagement and transfer to a picking station or area 107. Alternatively, if the tuft sensor detects a series of multiple open flights or conveyor sections (for example, three to ten open conveyor flights in a row), the control system can be alerted that the hopper 90 (FIG. 4) has run out of its supply of tufts or rosettes, and in response, the operator can either switch operation full time to the second hopper, or can be prompted to load the hopper(s) with a fresh series of tufts or rosettes. As additionally indicated in FIG. 4, each of the indexing tuft conveyors 93 further can include stops 108, such as pneumatic cylinders 109 having brakes or other stop mechanisms 111, which engage and halt further operation or forward movement of the indexing tuft conveyors in response to detection of a tuft or rosette being indexed into its discharge position by its indexing tuft conveyor.

Figure 5:
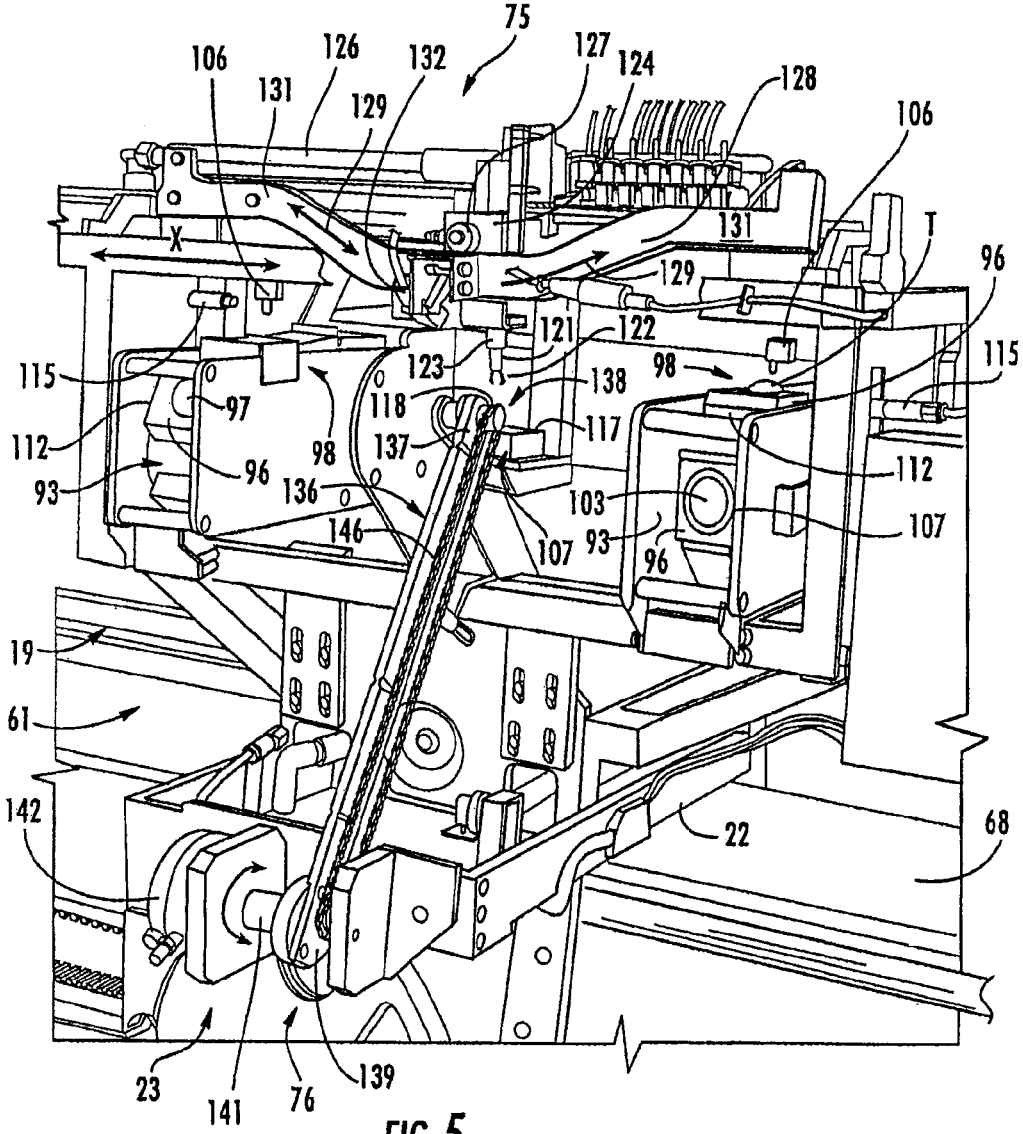
FIG. 5 is a perspective view of the first and secondary tuft transfer mechanisms of the quilting/tufting assembly illustrating the pivoting guide arm and grippers of the tuft.

As indicated in FIGS. 1C and 5, an upper section or portion 112 of each of the indexing tuft conveyors 93 for the tufts or rosettes extends out of the hoppers and along a longitudinal path with the tuft conveyors being stopped after each increment or indexed movement so as to place the tufts or rosettes into their pick or discharge position 98. As additionally shown in FIG. 5, each first or tuft sensor 106 can include a photocell, proximity detector or other, similar sensors, and generally will be positioned above and slightly upstream from the pick or discharge positions 98 for each of the tuft conveyors for detecting the presence or absence of the tufts or rosettes in each of the upcoming flights of the indexing conveyors. As noted, if a vacant or open flight is detected, the control system can be signaled to either index or continue the forward movement of the indexing conveyor, or if a sufficient number of vacant flights or openings is detected (e.g., 3-10), the system control can be signaled to alert the operator of a problem or the exhaustion of a supply of tufts or rosettes from that hopper.

As further illustrated in FIG. 5, a second or pick sensor 115 is positioned adjacent the discharge or pick position 98 for the tufts T or rosettes being conveyed by each indexing tuft conveyor 93. The pick sensor, as with the tuft detection sensor, can be a proximity sensor, photoelectric eye or other similar detector, and will detect the approach of the tufts or rosettes to their pick position. The pick sensor then will signal the system control to engage the stop 108 (FIG. 3) for that tuft conveyor 93 and stop further movement of the tuft conveyor. Thereafter, a first transfer or tuft picking mechanism 75 will be engaged so as to pick and remove the tuft or rosette from the flight 96 of its indexing tuft conveyor 93 and move the tuft to a centrally located transfer platform or seat 117 defining an intermediate transfer position 118 aligned with the sewing head 23 for transfer to the sewing head and presser foot assembly of the lower carriage.

As indicated in FIG. 5, the first transfer or tuft picking mechanism 75 generally includes a pneumatically operated gripper or pincher 121 having a pair of fingers or pinch arms 122 that engage and grip the tufts T or rosettes for removing the tufts from the flights of the tuft conveyors and moving the tufts to their transfer position 118. The pincher 121 generally will be mounted on a moveable support 123 attached to a carriage 124 driven by a drive actuator 126, such as a pneumatic cylinder, motor or other similar actuator under direction of the control system, so as to be moveable laterally between the discharge position 98 of each indexing tuft conveyor 93 and the generally centrally located transfer or loading position. The carriage 124 of the pincher 121 generally will further include a cam roller 127 that rolls along a generally U-shaped cam track 128, as indicated by arrows 129, so as to cause the pincher 121 to be raised and lowered as it is moved between the picking or discharge position and the transfer position for the tufts or rosettes. Thus, as indicated in FIG. 5, as the pincher is moved toward the picking or discharge position for picking a tuft or rosette from one of the indexing tuft or rosette conveyors, it will be raised by the rolling action of its cam roller along an upper section 131 of the cam track 128 so as to ensure that the pincher is raised out of potential engagement with the indexing conveyor until actuated.

The pincher 121 is moved laterally in the "X" direction until it reaches a stop position above the picking or discharge position 98 for the tuft T or rosette, after which the pincher will be lowered by a cylinder or similar actuator mounted on the carriage and the fingers or pinchers 122 of the pincher further will be actuated so as to open and then close to engage and grip the tuft or rosette. Once the tuft or rosette has been engaged, the pincher again will be raised so as to remove the tuft or rosette from the flight of its conveyor. The pincher and tuft thereafter will be moved to the central loading or transfer position 118 by the retraction of the carriage drive cylinder 126 or other drive actuator. Once the pincher has been moved to the central loading or transfer position, as detected by a third or transfer sensor 132, the pincher will be lowered and its fingers or pinch arms extended or spread apart so as to deposit the tuft or rosette on the transfer platform or seat 117. Upon detection of the depositing of a tuft or rosette in the transfer platform seat by the transfer sensor 132, the secondary tuft or transfer mechanism 76 will be engaged by the control system for transfer of the tuft or rosette to the sewing head 23.

Figure 6A:
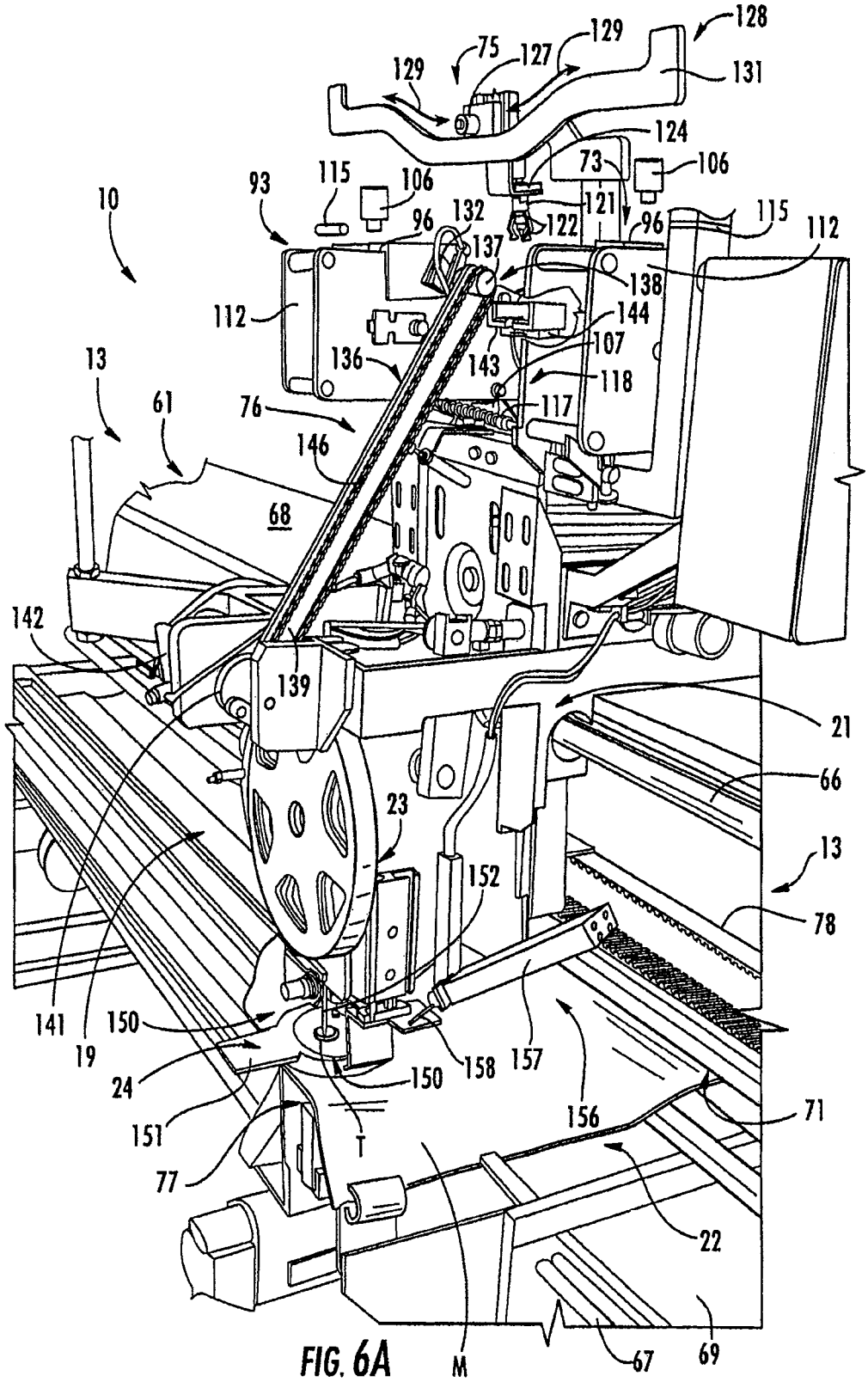
FIGS. 6A-6B illustrate the upper and lower carriages, the sewing head and tuft applicator of the quilter/tufter assembly according to one example embodiment of the present invention.
Figure 6B:
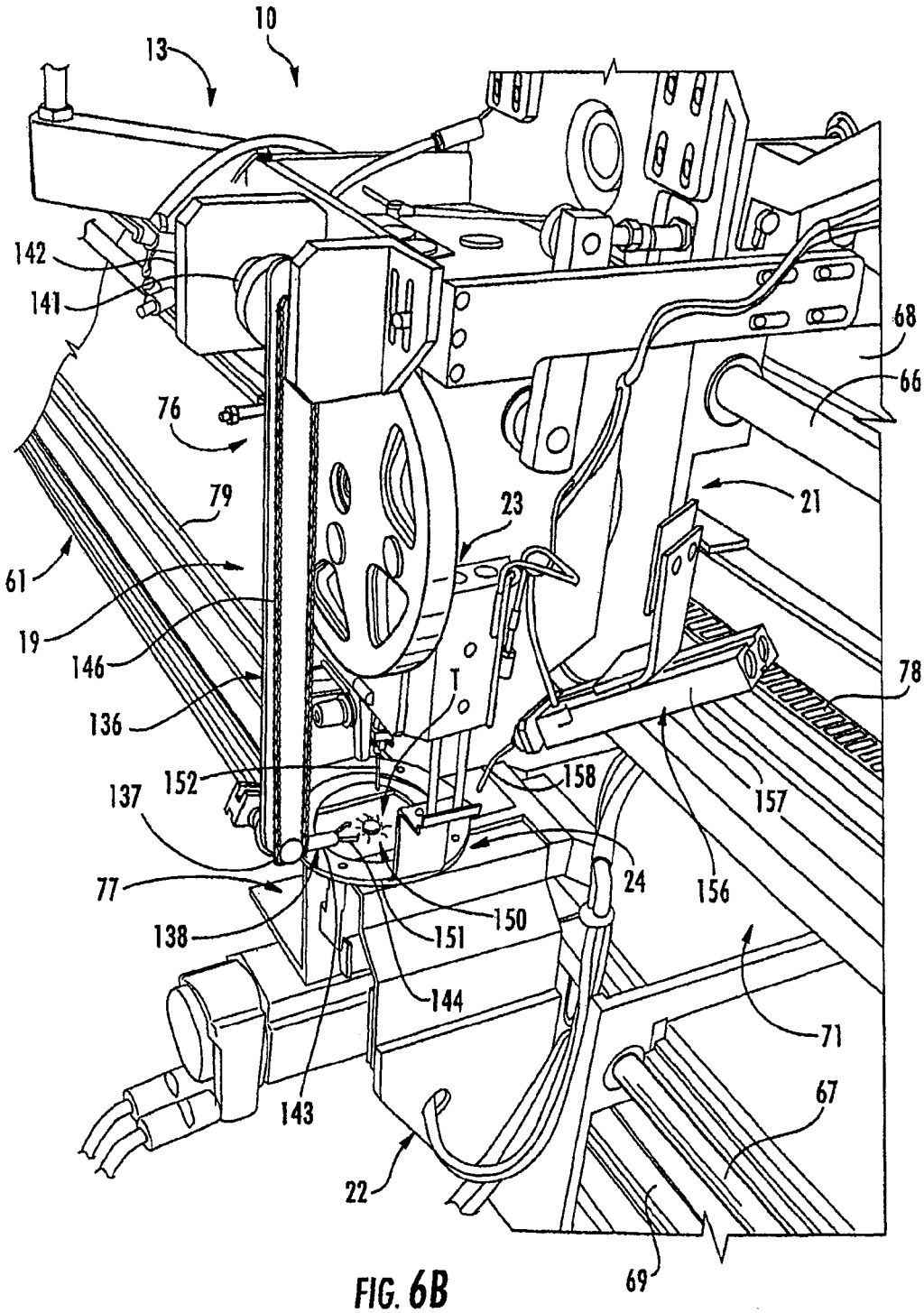

As indicated in FIGS. 6A-6B, the secondary picker or tuft transfer mechanism 76 generally will include a pivotable guide arm 136 pivotally mounted on framework 62 for the upper carriage 21. The guide arm generally includes a first or upper end 137 at which a gripper 138 is mounted, and a second or distal end 139 that is rotatably mounted to the drive shaft 141 (FIG. 5) of a rotary actuator, motor or similar drive mechanism 142. A pneumatic cylinder or other actuator 143 (FIGS. 6A-6B) typically is connected to the gripper 138, which generally includes a pair of moveable fingers or pinchers 144, in similar fashion to the pincher 121 first tuft transfer mechanism 75, so as to control the opening and contracting movement of the fingers or pinchers to enable them to engage and pick up a tuft or rosette from the transfer seat 117.

Thereafter, the control system will actuate the drive motor so as to cause the pivoting of the guide arm 136 over a desired range of movement (i.e., approximately 190° to approximately 200°, although greater or lesser ranges of movement also can be used) to move the tuft or rosette to a sewing position 150 on the looper or base portion 77 of the lower carriage 22 and into position for engagement by the presser foot 151. At generally the same time, the gripper 138 attached to the guide arm 136 also can be rotated and thus reoriented by operation of a drive belt 146 attached thereto and extending along the arm, which drive belt 146 can be linked to the actuator 142 of the guide arm 136 so as to be engaged with the rotation of the guide arm, or can be separately controlled by an independently activated drive. As a result, the tuft or rosette T will be further rotated and moved into a position for placement at the sewing area 150 or position on top of the fabric panel, as indicated in FIG. 6B. Once the tuft or rosette T is positioned on the panel at a desired location/sewing area 150, the presser foot assembly 24 can be actuated so as to move the presser foot into a lowered clamping position to clamp the panel P (FIG. 1C) in a compressed, fixed position as the sewing head 23 engages and sews the tuft or rosette to the panel.

As further shown in FIGS. 6A and 6B, the sewing head 23 generally will include a single-needle 152 scroll-type quilting or sewing head (although other types of programmable quilter or sewing heads also can be utilized including sewing heads with more than one needle). The sewing head will be operable under the control of the control system for the automated quilting and tufting system 10 for sewing a desired quilted, decorative pattern across the upper surface of the panel web, and additionally for attaching or applying tufts or rosettes at spaced locations across the panel web, as illustrated in FIG. 1C. The sewing head thus is operable as a single needle panel quilter with or without the application of tufts or rosettes. The presser foot assembly 24 (FIGS. 6A-6B) is mounted to the sewing head and generally includes a substantially circular presser foot 151 having an open sewing area 150 defined approximately centrally therein and generally aligned with the sewing needle 152 of the sewing head. The presser foot is moveable into a lowered, engaging position so as to clamp the panel web between the sewing head and a lower looper assembly or base 77 mounted to the lower carriage 22, with the tuft or rosette being received within the sewing area defined by the presser foot for attachment to a panel.

Additionally, as indicated in FIGS. 6A-6B, a thread wiper 156 is mounted to the frame of the upper carriage and sewing head, in a position adjacent the sewing area 150. The thread wiper 156 includes a cylinder or similar actuator 157 and a wiper arm 158 that is moveable into engagement with a thread carried by the needle 152 as the sewing head finishes sewing the tuft or finishes sewing of its quilted pattern so as to engage and pull out the bottom part of the thread for cutting, and thereafter pull the thread out of the way. Thus, the sewing operation can continue with the sewing head being moved selectively to additional locations or areas for sewing additional tufts and/or portions of the pattern.

As indicated in FIGS. 1A and 1B, once a panel of a desired size has been sewn and has the programmed or desired amount of tufts or rosettes applied thereto, the panel web W will be incremented forwardly into and through the downstream panel cutter. The panel web will be fed through the panel cutter until a desired or sufficient length of material has been detected by the encoder. As shown in FIG. 1A, the panel cutter generally includes a series of cutting assemblies 17, which can include a pair of side cutting assemblies 160/161, which typically include rotary cutting blades 162 that are mounted on holders 163 slidable along guide rails 164 so that the cutters can be positionable laterally in the "X" direction for cutting the side edges of the panels to a desired width. In addition, a longitudinal cutter 165, also typically including a rotary cutting blade 166 carried by a holder 167, is actuatable so as to cut laterally across the length of the panel web for cutting the panel to a desired size/length such as for forming a king size, queen size, double, etc., mattress. The panel cutter further can be provided with additional cutting blades for cutting the panel web into different sizes, i.e., for forming pairs of twin size mattress panels, or for cutting the panels into even smaller widths for use in forming borders or other bedding components.

In operation of the automated quilting and tufting system 10 of the present invention, the fabric materials M are fed from their rolls 12 (FIGS. 1A and 2), through the downstream intermediate quilting or tufting section 13 for attachment of a series of tufts or rosettes thereto, and/or for sewing of a tufted or quilted pattern within the panel materials. The panel materials generally are fed in a layered or stacked configuration and pass through an opening 71 in the drive platform 61 of the intermediate section 13. The web of panel material is fed in a sufficient length to form a desired size panel, such as a king size, queen size, double, etc., mattress panel. Once the desired length of panel material has been fed, as detected by a downstream encoder, the computer control system 18 (FIG. 1A) of the automated quilting and tufting system 10 will be alerted, and generally will halt the further feeding of the web of material into the intermediate section. Thereafter, the side edges of the web of material will be engaged by longitudinal clamps 36 and 36', as indicated in FIGS. 1A and 1C, with the web of material further being supported thereunder by the spaced support rods 51A-51E (FIG. 3).

With the web of panel material held in a clamped, supported position, the computer control system will engage the quilter/tufter assembly 19 for application of the tufts or rosettes and/or sewing of a quilted pattern therein. The tufts or rosettes will be fed from their hoppers 90 (FIG. 4) with each of the tufts or rosettes being received with a flight 96 of the tuft conveyors 93. The tuft conveyors will convey the tufts out of the hoppers and along a longitudinally extending path to a pick position 98 (FIG. 5). Upon reaching the pick position, the presence of the tuft at the pick position will be detected by a first tuft sensor 106, which will signal the computer control system to disengage the tuft conveyor and to further engage a stop mechanism 108 (FIG. 4) so as to prevent further movement of the tuft conveyor pending removal of the tuft therefrom. Should the tuft sensors not detect the presence of a tuft reaching the pick position for one or both of the tuft conveyors, such tuft conveyor can be further incremented forwardly by the control system until a tuft is detected reaching the pick position, or alternatively, operation can be shifted to the other hopper and/or the operator can be alerted that the hopper is jammed or that its supply of tufts or rosettes has been exhausted.

Once a tuft has been detected at its pick position, a first tuft transfer mechanism 75 (FIG. 5) will be actuated and will be moved laterally into a position above the pick position of the tuft. A second or pick sensor 115, positioned adjacent the pick position, detects the arrival of the gripper 121 of the first tuft transfer mechanism, whereupon the gripper 121 will be lowered and its fingers or pinch arms 122 will engage and grip the tuft. The gripper thereafter will be retracted vertically and moved laterally toward a substantially centrally located transfer position 118, whereupon the gripper 121 again will be lowered and its fingers or pinch arms 122 opened so as to release and deposit the tuft on a transfer platform or seat 117.

A secondary tuft transfer mechanism 76 then will be engaged for transfer of the tuft to sewing position 150 (FIGS. 6A and 6B). The gripper 138 of the secondary tuft transfer mechanism 76 will engage the tuft at the transfer position, and thereafter the guide arm 136 carrying the gripper 138 will be rotated approximately 180-200° into a lowered position, while the gripper 138 also generally is rotated so as to reposition the tuft for placement at the sewing area 150 (FIG. 6B) on top of the web of material. Thereafter, the presser foot 151 will be engaged against the web of material, while the tuft is engaged and sewn by the sewing head 23 for application of the tuft to the web of material. Once the sewing of the tuft to the web of material has been completed, the thread wiper 156 will be engaged so as to extend its wiper blade or finger 158 to capture the remaining thread, which will be cut and removed from the tuft to complete the sewing operation.

After completion of the application of all tufts needed or desired for the size panel being sewn and/or the application of any quilting or other decorative pattern being sewn therealong, the longitudinal clamps will be released from the side edges of the web of material and the web of material will be further incremented forwardly by an amount sufficient to feed the desired panel length through a downstream panel cutter 16 (FIG. 1A). Once a sufficient length of the panel material has been fed through the panel cutter to form the desired length or size panel, the longitudinal cutter 165 will be actuated for cutting the panel to a desired length. In addition, the sides of the panel can be further trimmed by a pair of side cutters 160 and 161 as the panel material is being fed through the panel cutter.

Accordingly, it can be seen that the present invention is directed to a system for automatically feeding and attaching tufts or rosettes or other decorative attachments and for forming quilted or other decorative patterns in a panel material. It will be understood by those skilled in the art that while the present invention has been described above with respect to a preferred embodiment, various additional changes, modifications, additions and variations can be made thereto without departing from the spirit and scope of the invention as set forth in the following claims.

It will be understood by those skilled in the art that while the present invention has been described above with respect to one example, preferred embodiment, various modifications, additions and changes can be made thereto without departing from the spirit and scope of the invention.

The invention claimed is:

1. An automatic panel tufting system, comprising;

a material infeed section for feeding a web of material toward a sewing area;

a supply of tufts for attachment to the web of material;

at least one tuft transfer mechanism moving the tufts from said supply and positioning the tufts at a desired location along the web of material at the sewing area;

a sewing head adjacent the sewing area for engaging and attaching each tuft to the web of material at a desired location therealong;

a drive platform moveable in a longitudinal direction including at least one carriage on which the sewing head is mounted and moveable across the drive platform in a lateral direction for moving said sewing head in longitudinal and lateral directions for sewing across the web of material; and an outlet section for conveying the web of material away from the sewing head and including at least one cutting assembly for cutting panels of a desired size from the web of material.

2. The automatic panel tufting system of claim 1 and wherein the at least one tuft transfer mechanism comprises a first gripper moveable between a pick position and a loading position for picking and moving each tuft from said supply of tufts to the loading position.

3. The automatic panel tufting system of claim 2 and wherein the at least one tuft transfer mechanism further comprises an actuator for moving the gripper between raised and lowered positions, a moveable carriage supporting the actuator and gripper and having a cam roller mounted thereto, and a cam track engaged by the cam roller for causing the carriage to be moved vertically to adjust elevation of the gripper as the carriage moves the first gripper between the pick and loading positions.

4. The automatic panel tufting system of claim 2 and further comprising a secondary tuft transfer mechanism for moving each tuft from said loading position to the sewing area.

5. The automatic panel tufting system of claim 4 and wherein the secondary tuft transfer mechanism comprises a guide arm moveable between the loading position and the sewing area, and a gripper attached to the guide arm for engaging and gripping the tuft.

6. The automatic panel tufting system of claim 1 and further comprising a series of hoppers for containing the supply of tufts.

7. The automatic panel tufting system of claim 6 and further comprising tuft conveyors extending through each of the hoppers to a pick position, wherein the tuft conveyors each comprise indexing conveyors having a series of flights each defining a recess in which a tuft is received and moveable incrementally to sequentially carry the tufts from their hoppers to their pick positions.

8. The automatic panel tufting system of claim 7 and further comprising a tuft sensor adjacent the pick position for the tufts moving along each tuft conveyor, each tuft sensor adapted to detect the presence of a tuft at the pick position for its tuft conveyor and engage a stop for the pick conveyor to halt further movement thereof as the tuft is removed from the tuft conveyor by the at least one tuft transfer mechanism.

9. The automatic panel tufting system of claim 1 and further comprising an intermediate section between the material infeed section and the outlet section, wherein the intermediate section further comprises a series of longitudinal clamps for engaging and holding the web of material during sewing, and a series of support rails moveable in a longitudinal direction along the intermediate section for supporting varying lengths of the web of material during sewing.

10. The automatic panel tufting system of claim 1 and further comprising a control system for controlling feeding of a length of the web of material sufficient to form a panel of a selected size, and for controlling sewing and application of tufts to the panel and subsequent cutting of the panel.

11. A method of automatically forming a tufted panel, comprising:

feeding a panel web in an amount sufficient to form a desired size panel;

feeding a series of rosettes from a supply;

moving a sewing head into a sewing position at a desired location along the panel;

transferring a rosette from the supply to the sewing position;

attaching the rosette to the panel at the desired location with the sewing head; and after application of a desired number of rosettes to the panel, feeding an additional amount of the panel web sufficient to form a next panel of a desired size.

12. The method of claim 11 and further comprising sewing a quilted pattern in the panel web surface.

13. The method of claim 11 and further comprising cutting the panel from the panel web after completion of the application of the rosettes.

14. The method of claim 11 and wherein feeding the series of rosettes from the supply comprises collecting a plurality of rosettes in at least one hopper, receiving each rosette within a flight of a tuft conveyor and conveying each rosette out of the hopper to a pick position.

15. The method of claim 14, wherein conveying the rosettes comprises incrementally moving the tuft conveyor with the rosettes therein to sequentially convey each rosette to the pick position, and upon detection of a rosette being moved into the pick position, stopping movement of the tuft conveyor and actuating a first tuft transfer mechanism to move the rosette from the pick position to a loading position for feeding to the sewing head.

16. The method of claim 15 and further comprising engaging the rosette at the loading position with a secondary tuft transfer mechanism and transferring the rosette to the sewing position on the panel.

17. The method of claim 15 and wherein if no rosette is detected at the pick position, continuing to increment the tuft conveyor forwardly for a desired number of increments or until a next rosette is detected reaching the pick position.

18. The method of claim 15 and further comprising feeding rosettes from a pair of hoppers with a pair of tuft conveyors, each tuft conveyor having a pick position defined therealong, and alternating picking and moving rosettes from the pick positions of each tuft conveyor.

19. The method of claim 18 and wherein if no rosette is detected at the pick position of one of the pair of tuft conveyors, continuing to pick and move rosettes from the other tuft conveyor.

* * * * *